US006926642B1

(12) United States Patent
Lampreda

(10) Patent No.: US 6,926,642 B1
(45) Date of Patent: Aug. 9, 2005

(54) EXERCISE DEVICE

(76) Inventor: Roderick D. Lampreda, 1319 St. Francis Dr., Los Banos, CA (US) 93635

( * ) Notice: Subject to any disclaimer, the term of this patent is extended or adjusted under 35 U.S.C. 154(b) by 595 days.

(21) Appl. No.: 10/023,412

(22) Filed: Dec. 14, 2001

(51) Int. Cl.[7] ..... A63B 21/00; A63B 21/018
(52) U.S. Cl. ..... 482/37; 482/114
(58) Field of Search ..... 482/35–37, 121–130, 482/114–120

(56) References Cited

U.S. PATENT DOCUMENTS

| | | | | |
|---|---|---|---|---|
| 641,519 | A | 1/1900 | Kerns | |
| 3,782,718 | A | 1/1974 | Saylor | |
| 5,060,938 | A * | 10/1991 | Hawley, Jr. | 482/37 |
| 5,076,574 | A * | 12/1991 | Johnson, Jr. | 482/37 |
| 5,316,535 | A | 5/1994 | Bradbury | |
| 5,380,258 | A * | 1/1995 | Hawley, Jr. | 482/37 |
| 5,484,360 | A * | 1/1996 | Haber et al. | 482/37 |
| 5,496,234 | A * | 3/1996 | Sussich | 482/37 |
| 5,645,514 | A | 7/1997 | Chen | |
| D425,585 | S | 5/2000 | Wu | |

* cited by examiner

*Primary Examiner*—Stephen R. Crow

(57) ABSTRACT

A exercise device for strengthening of the arms and back. The exercise device includes a frame having a base wall and a forked member that is attached to and extends upward from an upper side of the base wall. The forked member includes a pair of arms. A wheel is positioned between the arms and is rotatably coupled to the frame. An elastic band is positioned on and extending around a periphery of the wheel. A tension adjuster adjusts rotation of the wheel. The tension adjuster is attached to the frame for adjusting the rotation of the wheel. Exercise is provided by pulling on the elastic band and rotating the wheel.

9 Claims, 4 Drawing Sheets

EXERCISE DEVICE

BACKGROUND OF THE INVENTION

1. Field of the Invention

The present invention relates to exercise machines and more particularly pertains to a new exercise device for strengthening of the arms and back.

2. Description of the Prior Art

The use of exercise machines is known in the prior art. U.S. Pat. No. 641,519 describes an exercise device which is mounted on a vertical surface and uses a pulling motion for exercise. Another type of exercise machine is U.S. Pat. No. 5,496,234 which again uses a vertical mounted orientation for a pulling device.

While these devices fulfill their respective, particular objectives and requirements, the need remains for a device that allows a pulling motion where there person is in a seated position and pulling towards themselves.

SUMMARY OF THE INVENTION

The present invention meets the needs presented above by using a wheel mounted on a frame which extends vertically upwards from a base wall.

Still yet another object of the present invention is to provide a new exercise device that, unlike the previous art which is mounted on a wall, is positioned on a floor and may be stored after use.

To this end, the present invention generally comprises a frame having a base wall and a forked member that is attached to and extends upward from an upper side of the base wall. The forked member includes a pair of arms. A wheel is positioned between the arms and is rotatably coupled to the frame. An elastic band is positioned on and extending around a periphery of the wheel. A tension adjuster adjusts rotation of the wheel. The tension adjuster is attached to the frame for adjusting the rotation of the wheel. Pulling on the elastic band provides exercise and rotates the wheel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
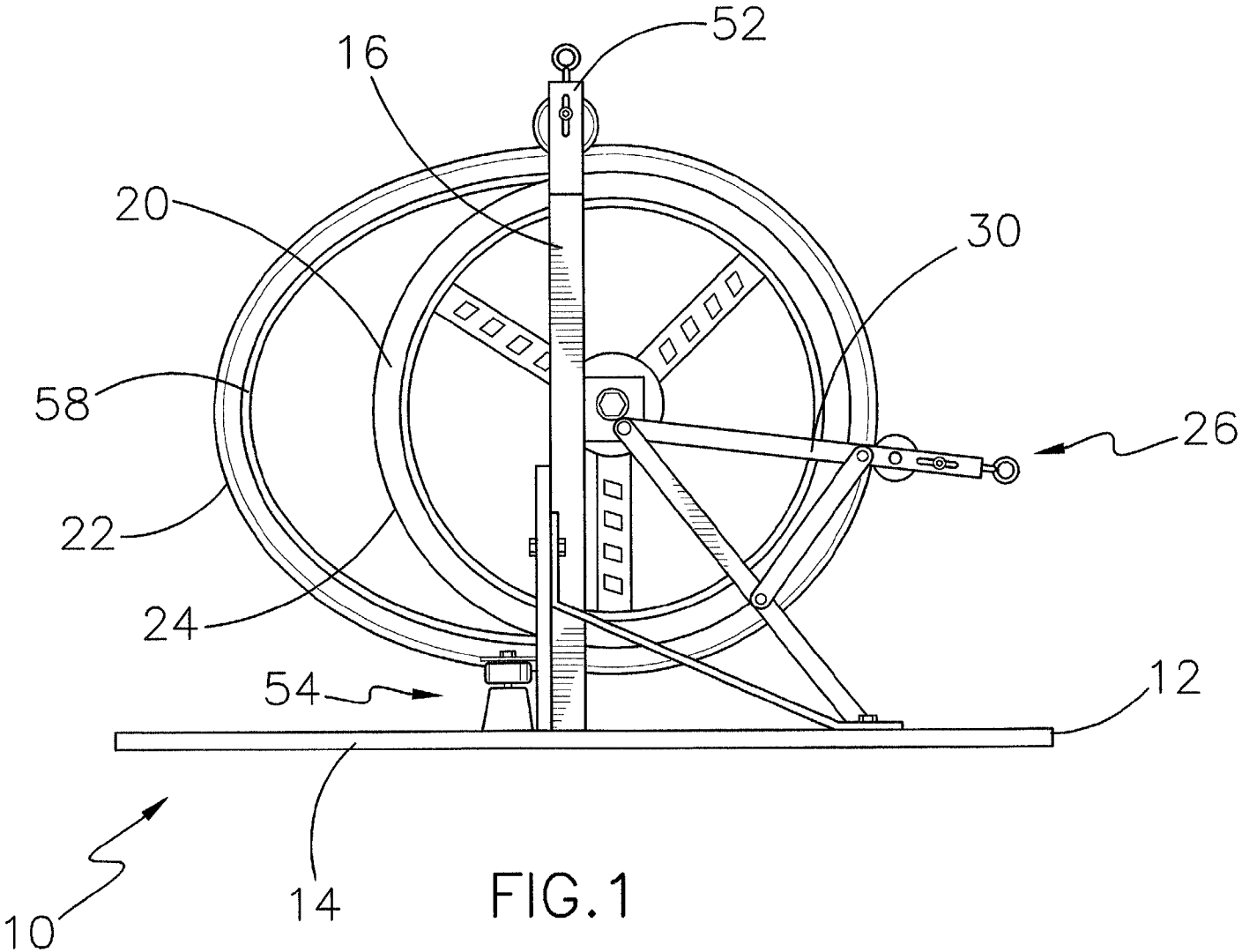
FIG. 1 is a schematic side view of a new exercise device according to the present invention.
Figure 2:
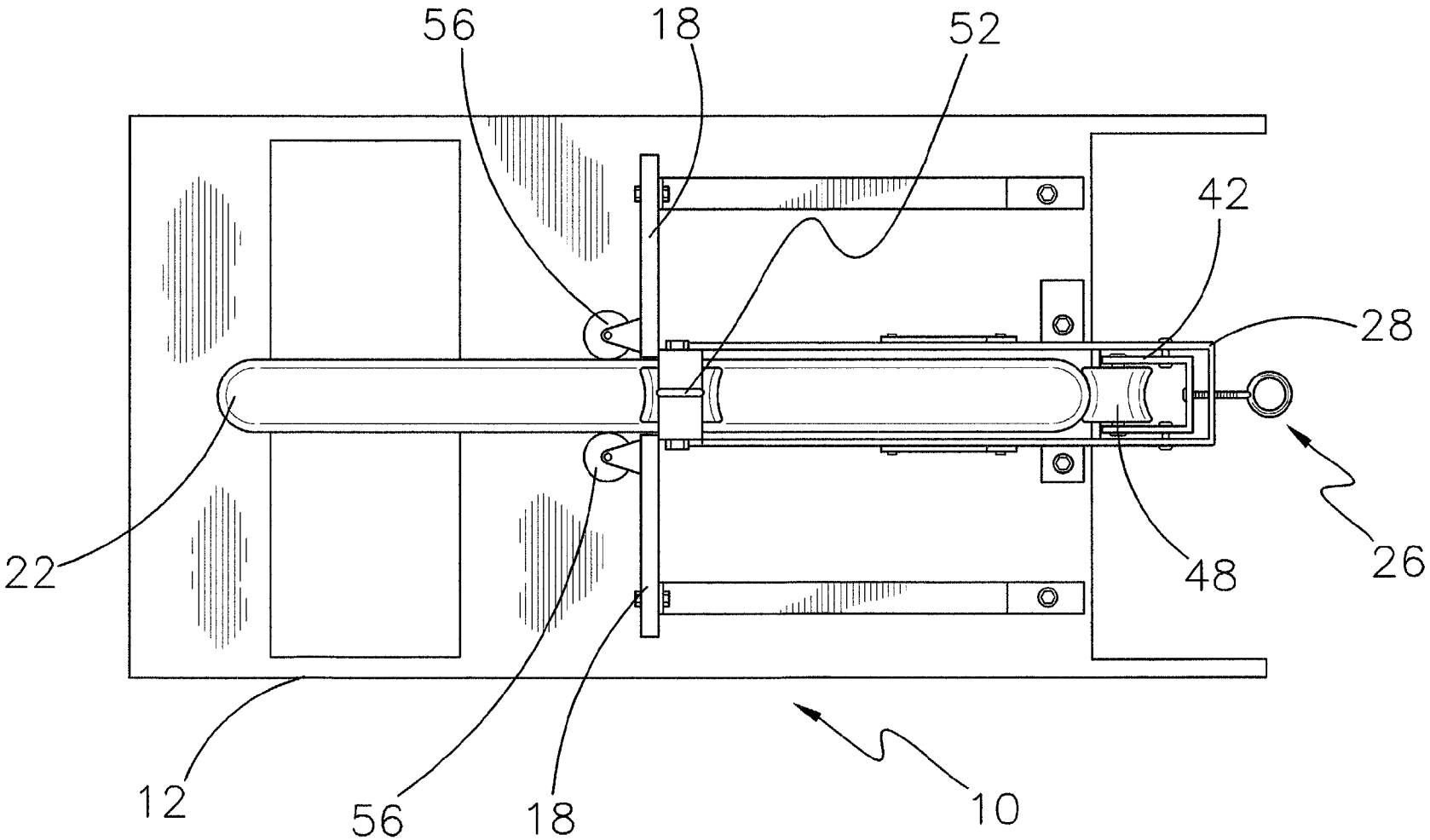
FIG. 2 is a schematic top view of the present invention.
Figure 3:
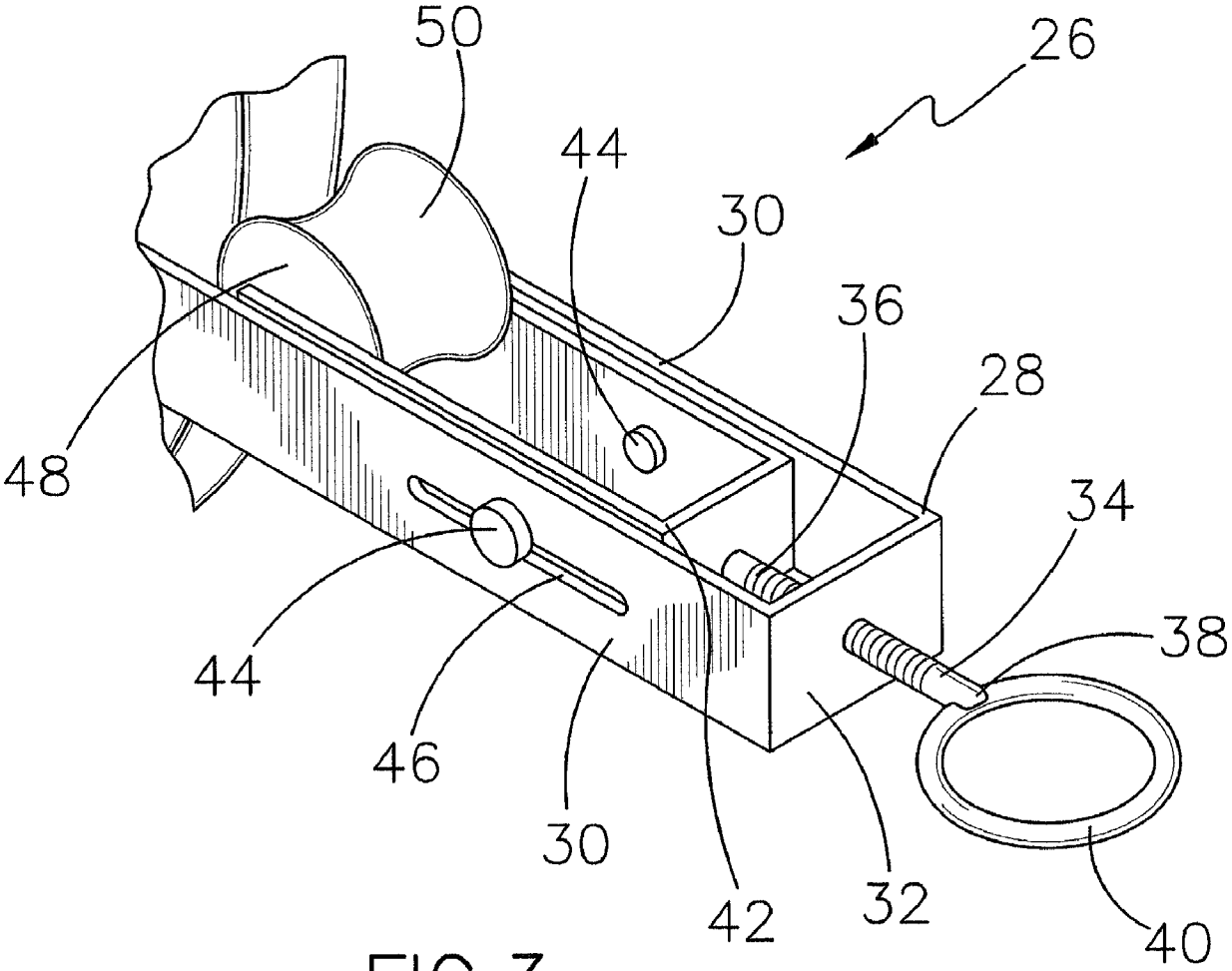
FIG. 3 is a schematic perspective view of a tension adjuster of the present invention.
Figure 4:
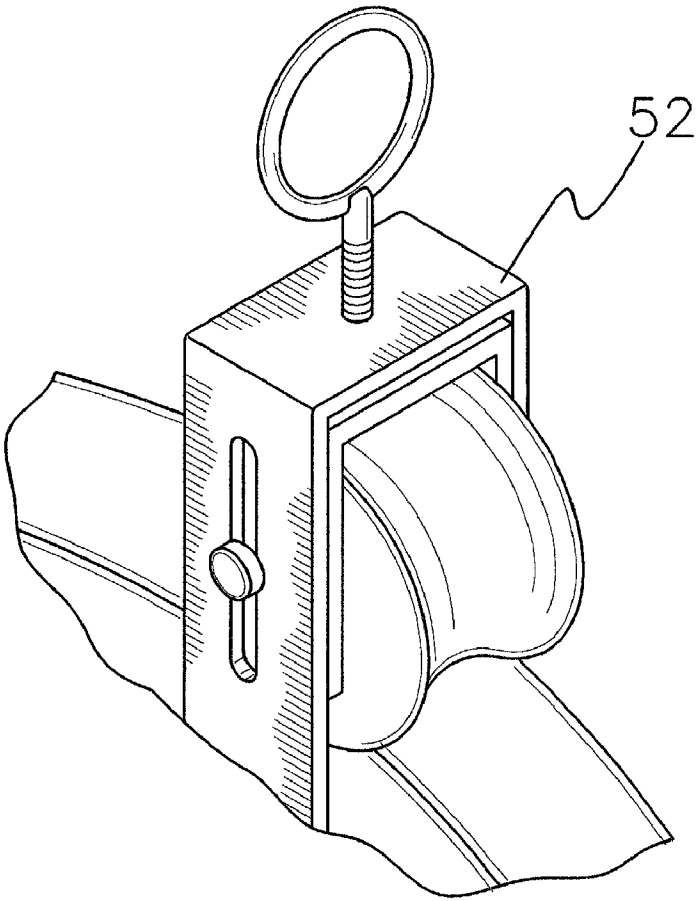
FIG. 4 is a schematic perspective view of a guide member of the present invention.

With reference now to the drawings, and in particular to FIGS. 1 through 4 thereof, a new exercise device embodying the principles and concepts of the present invention and generally designated by the reference numeral 10 will be described.

As best illustrated in FIGS. 1 through 4, the exercise device 10 generally comprises a frame 12 having a base wall 14 and a forked member 16 which is attached to and extends upward from an upper side of the base wall 14. The forked member 16 includes a pair of upstanding arms 18. A wheel 20 is positioned between the arms 18 and is rotatably coupled to the frame 12. An elastic band 22 is positioned on and extends around a periphery 24 of the wheel 20.

A tension adjuster 26 is attached to the frame 12 for adjusting rotation of the wheel 20. The tension adjuster 26 includes a first bracket 28 with a pair of legs 30 and a middle section 32 is attached to ends of the legs 30 such that the first bracket 28 generally has a U-shape. The first bracket 28 is attached to the frame 12 and extends away from the frame 12 such that each of the legs 30 is positioned on an opposite side of the wheel 12. The elastic band 22 is positioned between the middle section 32 and the wheel 22.

A rod 34 extends through and is threadably coupled to the middle section 32. The rod 34 has an inner end 36 extending toward the wheel 20 and an outer end 38. A handle 40 is attached to the outer end 38.

A second bracket 42 is attached to the inner end 36 of the rod 34 such that the second bracket 42 may be selectively moved toward or away from the wheel 20. A pair of stabilizers 44 is attached to the second bracket 42 and extend through elongated slots 46 in the legs 30.

A cylinder 48 is rotatably attached to the second bracket 42 and has an axis of rotation orientated parallel to an axis of rotation of the wheel 20. The cylinder 48 has a concave outer surface 50 in abutment with the elastic band 22. The cylinder 48 may be selectively positioned nearer the wheel 20 for placing tension on the wheel 20.

A first guide member 52 retains the elastic band 22 on the wheel 20 and is attached to an upper end of the forked member 16 such that the first guide member 52 extends over the wheel 20.

A second guide member 54 retains the elastic band 22 on the wheel 20 and is attached to the frame 12. The second guide member 54 includes a pair of rollers 56 each rotatably attached to the frame 12 and positioned generally adjacent to the base wall 14. Each of the rollers 56 is attached to one of the arms 18 and is in abutment with the elastic band 22. The rollers 56 have a rotational axis generally orientated perpendicular to the rotational axis of the wheel 20.

In use, the elastic band 22 is pulled and the wheel 20 rotated to provide exercise. Usually a user will do this sitting down and pull on a slack portion 58 of the band 22 shown in FIG. 1. In order to increase the resistance on the band 22, the user may use the tension adjuster 26 to place resistance on the elastic band 22 and wheel 20. By pulling on the elastic band 22, users may strengthen their arms and back muscles.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An exercise device comprising:

a frame having a base wall and a forked member attached to and extending upwardly from an upper side of said base wall, said forked member including a pair of arms;

a wheel positioned between said arms and rotatably coupled to said frame;

an elastic band positioned on and extending around a periphery of said wheel;

a tension adjuster for adjusting rotation of said wheel, said tension adjuster attached to said frame for adjusting the rotation of said wheel; and wherein the elastic band is pulled and said wheel rotated to provide exercise.

2. The exercise device as in claim 1, said tension adjuster including:

a first bracket attached to said frame and extending beyond said periphery of said wheel;

a second bracket attached to said first bracket and selectively positionable toward or away from said wheel; and a cylinder being rotatably attached to said second bracket and in abutment with said elastic band such that said elastic band is positioned between said cylinder and said wheel.

3. The exercise device as in claim 2, wherein said first bracket includes a pair of legs and a middle section attached to ends of said legs such that said first bracket generally has a U-shape, said first bracket attached to said frame and extending away from said frame such that each of said legs is positioned on an opposite side of said wheel, said elastic band positioned between said middle section and said wheel.

4. The exercise device as in claim 3, additionally comprising a rod extending through and threadably coupled to said middle section, said rod having an inner end extending toward said wheel and an outer end, a handle attached to said outer end, said second bracket attached to said inner end.

5. The exercise device as in claim 3, further including a pair of stabilizers attached to said second bracket and extending through elongated slots in said legs.

6. The exercise device as in claim 2, wherein said cylinder has a concave outer surface in abutment with said elastic band.

7. The exercise device as in claim 1, further including a first guide member for retaining said elastic band on said wheel, said first guide member attached to an upper end of said forked member such that said first guide member extends over said wheel.

8. The exercise-device as in claim 7, further including a second guide member for retaining said elastic band on said wheel attached to said frame, said second guide member including a pair of rollers each rotatably attached to said frame and positioned generally adjacent to said base wall, each of said rollers attached to one of said arms and in abutment with said elastic band, said rollers having a rotational axis generally orientated perpendicular to said rotational axis of said wheel.

9. An exercise device comprising:

a frame having a base wall and a forked member attached to and extending upward from an upper side of said base wall, said forked member including a pair of arms;

a wheel being positioned between said arms and rotatably coupled to said frame;

an elastic band positioned on and extending around a periphery of said wheel;

a tension adjuster for adjusting rotation of said wheel, said tension adjuster attached to said frame, said tension adjuster including;

a first bracket including a pair of legs and a middle section attached to ends of said legs such that said first bracket generally has a U-shape, said first bracket attached to said frame and extending away from said frame such that each of said legs is positioned on an opposite side of said wheel, said elastic band positioned between said middle section and said wheel;

a rod extending through and threadably coupled to said middle section, said rod having an inner end extending toward said wheel and an outer end, a handle attached to said outer end;

a second bracket being attached to inner end of said rod such that said second bracket may be selectively moved toward or away from said wheel, a pair of stabilizers being attached to said second bracket and extending through elongated slots in said legs;

a cylinder rotatably attached to said second bracket and having an axis of rotation orientated parallel to an axis of rotation of said wheel, said cylinder having a concave outer surface in abutment with said elastic band;

wherein said cylinder may be selectively positioned nearer said wheel for placing tension on the wheel;

a first guide member for retaining said elastic band on said wheel, said first guide member attached to an upper end of said forked member such that said first guide member extends over said wheel;

a second guide member for retaining said elastic band on said wheel attached to said frame, said second guide member including a pair of rollers each rotatably attached to said frame and positioned generally adjacent to said base wall, each of said rollers attached to one of said arms and in abutment with said elastic band, said rollers having a rotational axis generally orientated perpendicular to said rotational axis of said wheel; and wherein the elastic band is pulled and said wheel rotated to provide exercise.

* * * * *